US008581160B1

(12) United States Patent
Sanford

(10) Patent No.: US 8,581,160 B1
(45) Date of Patent: Nov. 12, 2013

(54) GYROSCOPIC STABILIZER

(75) Inventor: Matthew Sanford, Bel Alton, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 749 days.

(21) Appl. No.: 12/799,010

(22) Filed: Mar. 31, 2010

(51) Int. Cl.
*F42B 10/30* (2006.01)

(52) U.S. Cl.
USPC ..... 244/3.1; 244/3.23; 60/770

(58) Field of Classification Search
USPC ..... 244/3.1, 3.23, 3.28, 3.29, 12.2, 23 C; 60/770, 771; 239/265.19
See application file for complete search history.

(56) References Cited

U.S. PATENT DOCUMENTS

| | | | | |
|---|---|---|---|---|
| 2,500,537 | A | | 3/1947 | Goggard |
| 2,545,496 | A | | 3/1952 | Short |
| 2,611,317 | A | | 9/1952 | Africano |
| 3,561,362 | A | | 2/1971 | Black et al. |
| 4,007,586 | A | | 2/1977 | McDermott |
| 4,194,706 | A | | 3/1980 | Detalle |
| 4,307,651 | A | | 12/1981 | Batson et al. |
| 4,497,460 | A | | 2/1985 | Thorsted et al. |
| 4,936,218 | A | | 6/1990 | Wosenitz |
| 5,164,537 | A | | 11/1992 | Fritz et al. |
| 5,186,413 | A | * | 2/1993 | Deakin ..... 244/1 TD |
| 6,666,144 | B1 | | 12/2003 | Kim et al. |
| 6,672,072 | B1 | | 1/2004 | Giffin, III |

* cited by examiner

*Primary Examiner* — Timothy D Collins
*Assistant Examiner* — Nicholas McFall
(74) *Attorney, Agent, or Firm* — Fredric J. Zimmerman

(57) ABSTRACT

A gyroscopic stabilizer has a ring mounted at a missile rocket nozzle exit for rotation about the exit. The ring bears vanes extended inwardly into gases exiting from the nozzle and configured for rotation by the exiting gases so that the rotating mass of the ring gyroscopically stabilizes the missile. The ring may be mounted by a bearing having rolling elements or sliding surfaces. The axial length of the ring may be substantially less than its diameter. The ring has a low moment of inertia and is accelerated to stabilizing speed by vanes minimally impeding the exiting gases. When the stabilizer is used on a rocket propelled missile launched from a tube, the missile is fully stabilized in the tube before burnout and there is no rotational friction between the tube and the missile.

20 Claims, 6 Drawing Sheets

GYROSCOPIC STABILIZER

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates to missile stabilization by rotation and relates to rockets having an element rotated by gas discharge.

(2) Description of the Related Art

It is well known to gyroscopically stabilize an elongated body such as a football, bullet, or rocket propelled missile by rotation of the entire body about its longitudinal axis. While it is conceptually possible to achieve such stabilization by rotation of a portion of such a body, insofar as known to the applicant, no such arrangement for gyroscopic stabilization has been deployed to any extent, if at all, despite possible advantages.

For example, in unguided, shoulder launched, recoilless rocket munitions, the current state of the art is rotation of an entire munition around its axis by fins, which pop-out at the tail of the munition, by rifling grooves within a launcher tube engaging the munition, or by fins or cutouts disposed at a rocket nozzle for impingement by rocket exhaust gases.

With these munitions, rocket gas generation must end before the munition has left the launching tube to prevent injury to the operator and is typically in the order of 0.01 second. Also in these munitions, simplicity and low cost are essential, so that no active guidance can be provided and the munition is guided solely by directing its launching tube.

Pop-out fins do not begin to rotate a munition until after it has exited its launcher so that a munition with pop-out fins is subject to misdirection immediately upon exiting the tube as by wind forces, tipping by gravity, or residual unbalanced gas forces. Also, with pop-out fins there are many parts to be assembled; the fins create excess drag; they may engage objects along the trajectory; and the shock of pop-out may damage the munition.

Rifling adds to the weight and expense of the launcher, creates an unbalanced force, and incurs friction losses.

With fins or cutouts for impingement by rocket exhaust, the burn time is extremely short and the entire munition is relatively heavy, a useful amount of rotational inertia cannot be obtained without large internal nozzle features that impede gas flow and cause thrust loss. Also, the munition spins against a launching tube incurring friction losses. Such thrust and friction losses also occur when a munition is rotated by auxiliary nozzles having a circumferential direction.

The advantages of rotating less than all of a munition for gyroscopic stabilization are recognized in U.S. Pat. No. 6,666,144, which issued to Kim et al on 23 Dec. 2003, and in U.S. Pat. No. 2,611,317 issuing to Africano on 23 Sep. 1952. However, in these patents the rotating part has a axial length substantially greater than its diameter and, thus, apparently a relatively high moment of inertia.

U.S. Pat. No. 6,666,144 discloses a rocket motor and warhead system where the warhead is decoupled from the rocket motor so the entire motor can spin separately. The motor is spun by "flutes machined in the rocket nozzle body." Relative motion between the motor and warhead is provided by annular bearings typically made from a plastic material, such as, polytetrafluoroethylene or "acetal", and a "dry film lubricant" may be applied to reduce friction. Such a bearing is stated to be less expensive than a ball bearing and to not degrade during storage as do lubricants used with ball bearings. It is apparent that this patent does not disclose decoupling of a portion of a rocket motor from the rest of the motor. Accordingly, the disclosed decoupled motor has a relatively higher moment of inertia than any lesser portion of the motor so that internal nozzle features, which impede gas flow, are required to a greater extent than with such a lesser motor portion.

U.S. Pat. No. 2,611,317 discloses a rocket projectile in which a conical nozzle exit portion is rotationally mounted on the rest of the motor and projectile by a ball bearing at the nozzle throat. The nozzle portion is provided with internal vanes responsive to the flow of propellent gases to rotate the nozzle portion. This patent is restricted to rotating the entire conical, rearward portion of the nozzle. It is apparent that this conical, rearward portion has a relatively higher moment of inertia than any lesser portion of the nozzle or motor so that internal nozzle features which impede gas flow are required to a greater extent than with such a lesser portion.

Also in U.S. Pat. No. 2,611,317, the conical portion is mounted rotationally at the nozzle throat where the temperature and pressure are relatively high with attendant sealing difficulties, particularly at ball bearings having the above-mentioned storage problems. Further, the conical portion is cantilevered from the rest of the motor at the bearing and seal region so that precision fitting and careful balance would be required for maximum effectiveness.

SUMMARY OF THE INVENTION

The present invention, in an exemplary embodiment, utilizes a ring rotationally mounted on a propelled body and rotated by at least one fluid flow associated with propulsion of the body. For example, the fluid flow may be air flowing externally of the body due to passage of the body through the atmosphere or, in particular, may be gases exiting from a rocket nozzle for propelling the body. The mass of the ring is selected so that, at the rotational speed provided by the flow, the rotating ring gyroscopically stabilizes the body.

Generally, a propelled body is elongated along an axis which corresponds to the direction in which the body is propelled, and the features of the body generally have, at many places along the axis, a circular cross section about the axis. Such an axis is, also, the central axis of a ring embodying the present invention.

The ring is rotated by vanes extending generally radially from the ring into the fluid flow and configured in any suitable manner, as in the turbine art, so that impingement of the flow on the vanes motivates the ring rotationally about its axis. The ring and the vanes may be mounted in any suitable disposition in relation to a propelled body for extension of the vanes into the desired flow. Thus, the vanes may extend radially outwardly from the ring into air flow externally or the body or the vanes may extend radially inwardly of the ring into rocket propulsion gases flowing centrally of the ring. In some applications and exemplary embodiments, it may be desirable to provide a ring of the subject invention with vanes extending inwardly and outwardly for driving the ring by fluid flows both internally and externally of the ring.

In an exemplary embodiment, the present invention is particularly effective with such a ring rotationally mounted on a rocket nozzle of a missile. The ring is disposed at and around the exit of the nozzle for rotation by propulsion gases exiting from the nozzle and centrally through the ring. In this exemplary embodiment, only inwardly extending vanes are required, and the external diameter of the ring would be somewhat less than that of a launching tube for the missile. These gases may have a velocity of as much as 6000 feet per second in the shoulder-launched missile application described above where the missile is fully accelerated by a rocket burning out in the launching tube. The ring may, at the same time and by vanes that minimally impede the exiting gases, be rotationally accelerated to such a speed that only a relatively light and low moment of inertia ring is needed for gyroscopic stabilization of the entire missile. In the above application, a ring embodying the principles of the present invention may have the necessary weight and moment of inertia with an axial length less than its diameter or even not more one-fourth of its diameter.

Any suitable bearing arrangement providing low friction in both the radial and longitudinal directions may be used to mount the a ring of the present invention on a corresponding nozzle.

With the above-identified shoulder launched, recoilless rocket munitions, where rocket gas generation is, generally, in the order of 0.01 second, a bearing arrangement at the rocket nozzle exit will not be subjected to a relatively high temperature if not directly impacted by the exhaust gas. As a result, conventional bearing structures and materials, which are not especially heat resistant, may be effective in the practice of the exemplary embodiment of the present invention.

Conventional ball or roller bearings, conventionally lubricated, may be used with the inner race being part of or attached to a rocket nozzle of otherwise conventional construction and with the outer race being part of or attached to a stabilizing ring of the present invention.

However, where simple and inexpensive construction is important and where rocket gas generation is in the order of only 0.01 seconds, such a ring may be mounted by a bearing having sliding surfaces disposed between solid materials even though thrust loads may be high. Such surfaces may employ an anti-friction material, such as; polytetrafluoroethylene or graphite, either in materials filled therewith or as a dry lubricant, or might be hardened, smooth steel surfaces lubricated with appropriate grease. The sliding surfaces may be a portion of a unitary nozzle or a unitary stabilizing ring or may be a layer or an insert applied to the nozzle or ring.

A nozzle constructed of graphite composite material may give a satisfactory anti-friction surface. Further, this nozzle also may have sufficient strength to withstand the necessary forward acceleration force on a stabilizing ring of the present invention, and also withstand with gas thrust forces acting rearwardly on the rotating vanes of the ring.

A bearing for mounting a rotating ring at the exit of the rocket nozzle, regardless of whether the bearing contact is by rolling elements or surfaces of solid materials, may be assembled by a pair of annular elements. The pair of elements have the bearing contact between the elements and may be connected by screw-threads arranged so that the rotational thrust of the ring does not disconnect the annular elements. With such a bearing, one of the annular elements may be the ring itself, and either may be a rolling element race or associated with a sliding bearing surface.

It may be desirable to provide a certain amount of sliding friction between bearing surfaces mounting a rotating, rocket projectile stabilizing ring of the present invention so as to rotate the rest, or some portion, of the projectile at a relatively low speed for balancing out imperfections in the projectile's construction It is a general object of the present invention to provide improved accuracy in rocket propelled devices, particularly shoulder-launched missiles.

Another object is provide such improved accuracy without compromising missile weight or velocity.

A more specific object is to provide such improved accuracy without rotation of the body of a missile so as to eliminate rotational friction between the body and a launching tube and spinning-body, Magnus effects after launching.

Another more specific object is to provide such improved accuracy by gyroscopic stabilization that is fully effective before exit of a missile from a launching tube so as, at exit, to avoid tip-off errors, and immediately resist deviations by the wind.

A further object is to provide, in a shoulder-launched or other rocket propelled device, greater gyroscopic stabilization than can be obtained by rotating the entire device or a major portion thereof.

A particular object is to provide such gyroscopic stabilization in a missile propelled by a rocket that burns out before exiting a launching tube.

Still another object is to provide the above advantages with minimal impedance to rocket nozzle gas flow.

Yet another object is to provide the above objects with a structure, which is light in weight and easily adaptable to existing missiles, launching tubes, and logistics.

Still further objects are to provide the above and other objects by simple, economical, sturdy, and fully effective structures for shoulder-launched missiles and other rocket propelled devices.

DETAILED DESCRIPTION OF THE INVENTION

Figure 1:
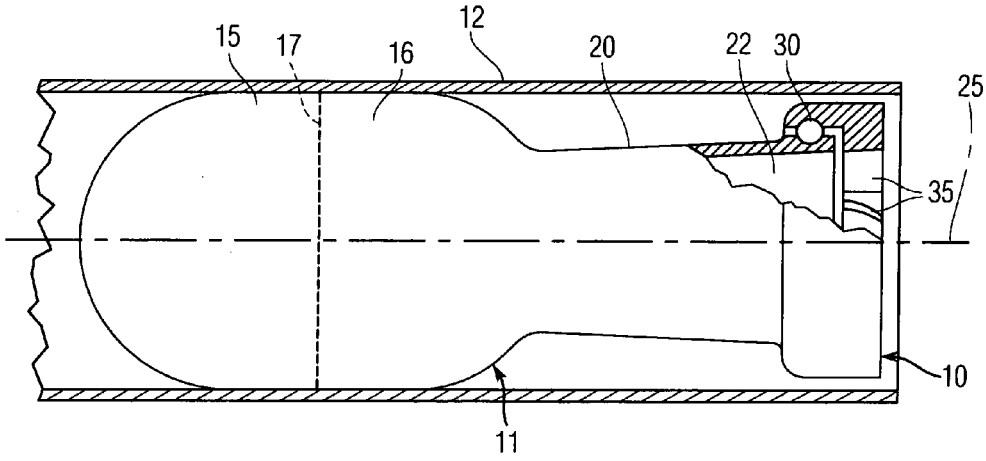
FIG. 1 is a schematic axial section of elements of a weapon system, including a fragmentarially represented launching tube within which is a rocket propelled missile having, at the exit end of a conical nozzle of the missile, a gyroscopic stabilizing ring embodying the principles of the present invention, the nozzle and ring having portions broken away to show interior structure including a ball bearing and internal rotating vanes of the ring.
Figure 2:
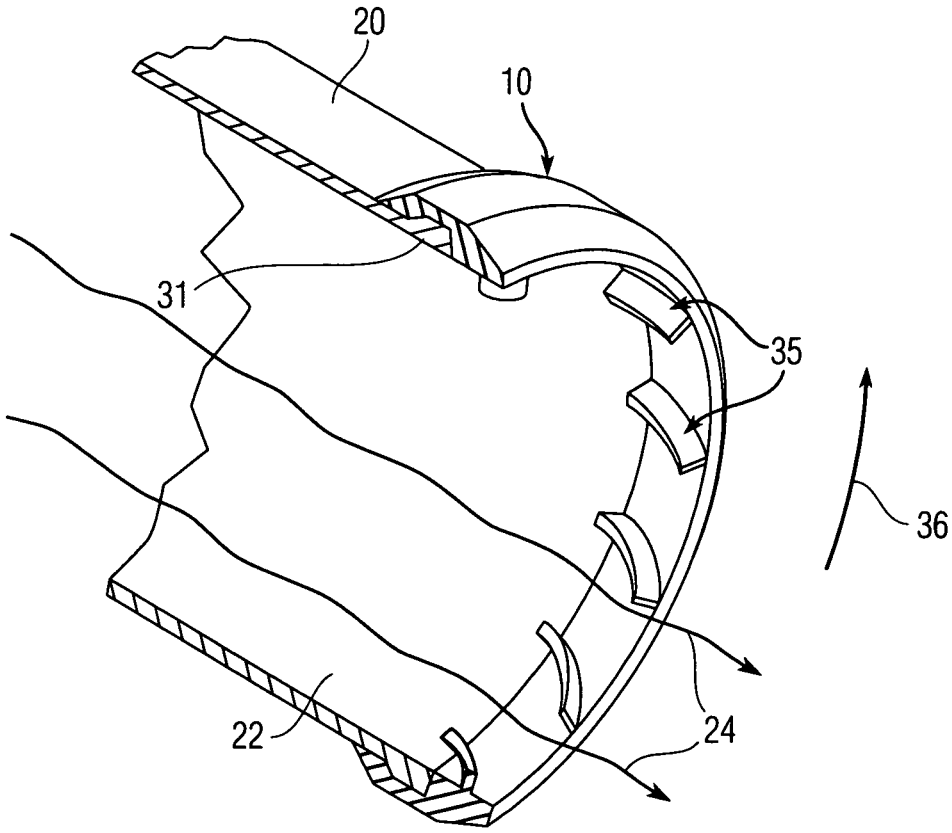
FIG. 2 is a fragmentary perspective section of a nozzle and stabilizing ring similar to that of FIG. 1, but at an enlarged scale and having a bearing utilizing sliding surfaces.

Referring with greater particularity to the drawings, FIGS. 1 and 2 show a first embodiment of the present invention as a gyroscopic stabilizing ring 10 depicted in a schematically represented weapon system including a shoulder launched, unguided missile generally indicated by numeral 11 and disposed in a launching tube 12 from within which the missile is launched. Such a missile generally has a forward warhead portion 15, which is not involved in the present invention, and has a rearward rocket motor or rocket portion which is indicated generally by numeral 16 and which, for purposes of exposition, may be considered as rearward of dash line 17.

Rocket motor 16 has a rearwardly diverging, conical rocket nozzle 20 disposed in propulsive relation to the rest of the missile and terminating in a circular exit opening 22 of predetermined diameter for propulsion gases generated by the motor and indicated in FIG. 2 by arrow 24 so as to propel missile 11 in a direction opposite arrow 24. The exiting of propulsion gases from opening 22 is initiated before the missile leaves the launching tube 12 and continues for a predetermined length of time. In shoulder launched missiles the length of the tube and amount of rocket propellant are selected so that, as mentioned above, exiting of propulsion gases from the nozzle terminates before the missile leaves the launching tube, generally, in not more than about 0.01 second.

It is evident that missile 11 is a propelled body and that gases 24 are a fluid flow associated with propulsion of the body, and pass in a predetermined direction relative to the body. This direction being along a central axis 25, shown in FIG. 1, along which the missile is elongated and propelled. The central axis 25 is the central axis of ring 10, nozzle 20, and opening 22, as well as the rest of the missile which, generally, is configured with circular cross-sections and is thus generally cylindrical.

Referring again to FIGS. 1 and 2, it is seen that ring 10 is mounted on nozzle 20 at opening 22 and coaxially thereof for passage of propulsion gases 24 axially of and centrally through the ring 10. The inner diameter of the ring 10 corresponding to the diameter of opening 22 by being substantially the same for least disturbance of the flow of the gases.

More particularly, the ring 10 is shown as so mounted by a bearing disposed on the nozzle, such a bearing is indicated by numeral 30 in FIG. 1 and by numeral 31 in FIG. 2. The bearing serving to position the ring axially in relation to the nozzle and provide for rotation of the ring relative to nozzle 20 and about its exit opening 22. This rotation is provided by bearing 30 being a ball bearing, and bearing 31 utilizing sliding surfaces. Particular arrangements of these bearings being described in greater detail below.

Ring 10 bears a plurality of turbine-like vanes 35, which extend radially inwardly of the ring and may be disposed so as to extend into propulsion gases 24. The vanes are configured so that the flow of these gases impinging on the vanes motivates the ring rotationally about axis 25 so that rotation of the ring, as indicated by arrow 36 in FIG. 2, tends to gyroscopically stabilize missile 11, the mass and moment of inertia of the ring being selected for this purpose.

Vanes 35 are fixedly connected to the ring 10, generally as shown in the Figures, by being unitarily constructed therewith in any suitable manner. The ring and vanes may be constructed of any suitable material such that the rotating elements associated with the ring 10 have a desired moment of inertia for stabilizing missile 11. If required, the material can be selected to withstand the temperature and erosion of propulsion gases 24. However, in the above-described shoulder launched missile application of the present invention no heat resistant materials are required.

Also in this exemplary embodiment where the corresponding fluid flow, such as gases 24, has satisfactory velocity characteristics and where the corresponding vanes, such as vanes 35, are suitably configured to drive a stabilizing ring, for example, corresponding to ring 10, to a rotational speed sufficient to stabilize, gyroscopically, a body, such as missile 11, the ring may be narrow axially. Since the ring will, accordingly, have a low moment of inertia, the ring may be accelerated to stabilize rotational speed by vanes minimally impeding the exiting gases.

More particularly, and as seen in FIGS. 1 and 2 where the inner diameter of stabilizing ring 10 is about the same as the diameter of the nozzle opening 22, the axial length of the ring may be not more than one fourth of the opening diameter diameter and thus less than this diameter or the outer diameter of the ring.

The gyroscopic stabilizer structure just described and shown in FIGS. 1 and 2 may be particularly effective when used in a method, mentioned above, for stabilizing rocket propelled, shoulder launched missiles typified by missile 11.

In this method, propulsion gases 24 from opening 22 may rotate ring 10 during a length of time beginning at initiation of rocket gas generation and may terminate shortly before missile 11 exits from its launching tube 12 so that rocket burnout occurs in the launching tube. This length of time is such that gases 24 impinge on vanes 35 and drive ring 10 and its associated rotating elements to a rotational speed sufficient for gyroscopic stabilization of missile 11. These events occur before: exiting launching tube 12 with a particular moment of inertia of ring 10; with particular velocity characteristics of gases 24, such as its impulse and variation during the length of time; and with a configuration of vanes 35 adapted for these velocity characteristics. This stabilization may be achieved, as stated above, by vanes, such as vanes 35, which minimally impede gases 24.

Based on this method, a rocket propelled missile exemplified by missile 11 is fully stabilized in its launching tube, for example, tube 12, before rocket burnout occurs in the tube. Accordingly, and during launching, there is no rotational friction between the tube and the missile.

One skilled in the arts of rocket propelled missiles and rotating, fluid driven devices may be able to determine effective structural and propulsive parameters for gyroscopic stabilization, in accordance with the present invention corresponding to missile 11.

Figure 3:
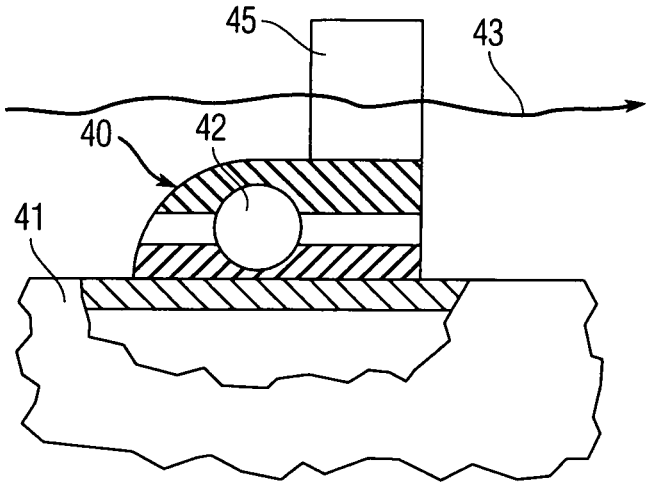
FIG. 3 is another embodiment of a fragmentary section showing a gyroscopic stabilizing ring embodying the principles of the present invention, having only external rotating vanes, and being mounted by a ball bearing.

Another embodiment of a gyroscopic stabilizer of the present invention is represented in FIG. 3 where a gyroscopic stabilizing ring 40, is mounted externally of a body 41 by a bearing 42, which positions the ring 40 axially in relation to the body 41 and provides for rotation of the ring 40 about the body 41. Bearing 42 is depicted as a ball bearing, but any suitable bearing may be used as discussed below. The body 41 is propelled through a fluid so that there is a flow, as indicated by arrow 43, of the fluid external to and axially of the ring 40. The ring 40 has a plurality of vanes 45 extending radially outward from it into flow 43 so that the flow impinges on the vanes and motivates the ring rotationally about its axis. The resulting rotation of the ring tending to stabilize, gyroscopically, the body.

The fluid may be atmospheric air, as with a surface weapon, or may be water as with a submarine vehicle. In any case, the ring 40 is provided with a suitable mass and configuration of its vanes so that, in an intended application, a device represented fragmentarily by body 41 is stabilized in accordance with the principles of the present invention. Since ring 40 is driven by flow 43 of fluid through which body 41 passes, ring 40 and vanes 45 need not be disposed at any particular location along the body. Accordingly, in FIG. 3, body 41 is depicted as extending forward and rearward of the ring.

Figure 4:
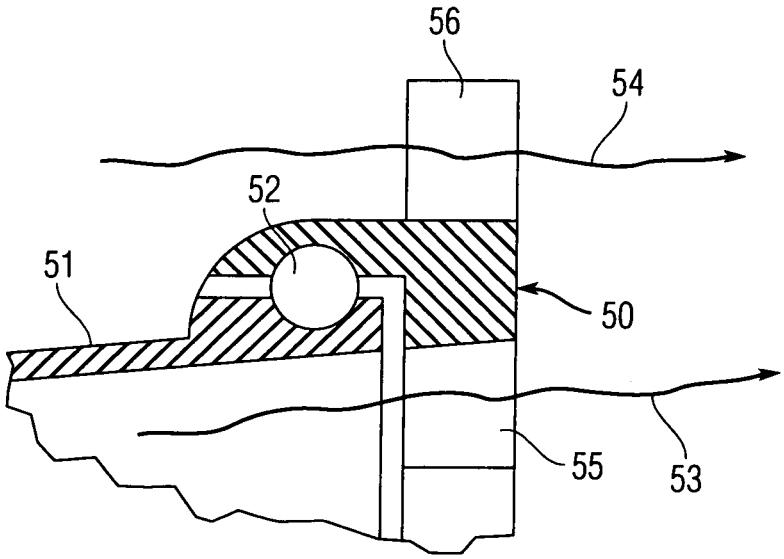
FIG. 4 is a fragmentary section showing an additional embodiment of a gyroscopic stabilizing ring embodying the principles of the present invention, having both internal and external rotating vanes, and being mounted by a ball bearing.

A further embodiment of a gyroscopic stabilizer of the present invention is represented in FIG. 4 which shows a gyroscopic stabilizing ring 50 mounted on a body 51 by any suitable bearing 52, which, as with bearing 42, positions the ring axially in relation to the body and provides for rotation of the ring 50 about the body 51. Ring 50 is disposed so that there is a fluid flow 53 centrally through the ring 50, and also a fluid flow 54 externally thereof. These flows being in directions generally along the axis of the ring. Flow 53 may be propulsion gas as with ring 10, body 51 then being a nozzle corresponding to nozzle 20; and flow 54 may be in fluid through which body 51 is propelled by flow 53. Ring 50 bears vanes 55 extending radially inwardly into flow 53 and bears vanes 56 extending radially outwardly into flow 54. Vanes 55 and 56 are appropriately configured in relation to flows 53 and 54 so that each of these flows, which are associated with propulsion of body 51, can motivate the ring rotationally about its axis and the resulting rotation of the ring tends to gyroscopically stabilize the body.

In the various embodiments of the present invention, bearings 30, 31, 42, and 52 are shown as mounting the corresponding gyroscopic stabilizing rings 10, 40, and 50 on the associated missile 11 or propelled body 41 or 51. It is mentioned above that the bearing may have rolling contact, as with bearings 30, 42 and 52, or sliding contact as with bearing 31. In particular applications of the subject invention, rolling or sliding contact may be advantageous. Particular structures and materials for these purposes will shortly be described with reference to FIG. 5, which shows a ball bearing structure identified by numeral 60, and to FIG. 6, which shows a bearing structure identified by numeral 61 and employing sliding contact.

In either case, axial forces due to impingement of fluid flows 24, 43, 53, and 53 on the corresponding vanes may be transferred to the associated missile, related rocket nozzle, or body without axial displacement of the ring along its axis relative to the missile, nozzle, or body. Moments due to gyroscopic reaction in planes intersecting this axis must be transferred to the missile, nozzle, or body without displacement of the ring axially or transversely, so that these moments can provide the gyroscopic stabilization of the present invention.

More specifically, in the embodiment of FIGS. 1 and 2, bearings 30 and 31 provide ring 10 and nozzle 20 with connecting elements such that the ring is maintained in coaxial disposition to nozzle exit 20 for rotation relative thereto by propulsion gases 24. Accordingly, the ring 10 is maintained in an axial disposition relative to the nozzle for transfer of axial forces and moments between the nozzle 20 and the ring 10.

A bearing mounting a gyroscopic stabilizing ring 10, 40, or 50 of the present invention, and providing the above described transfers of forces and moments, must not have enough rotational friction to impede rotation of the ring by the corresponding fluid flow to the extent that stabilizing rotational speed is not attained.

Bearing structures 60 and 61 have common features due to similarities in their function and assembly. These features may be identified by the terms used in the claims where a claim covers common features. The numerals used in FIG. 6 with structure 61 have a numerical value ten greater than the corresponding numerals used in FIG. 5 with structure 60.

Figure 5:
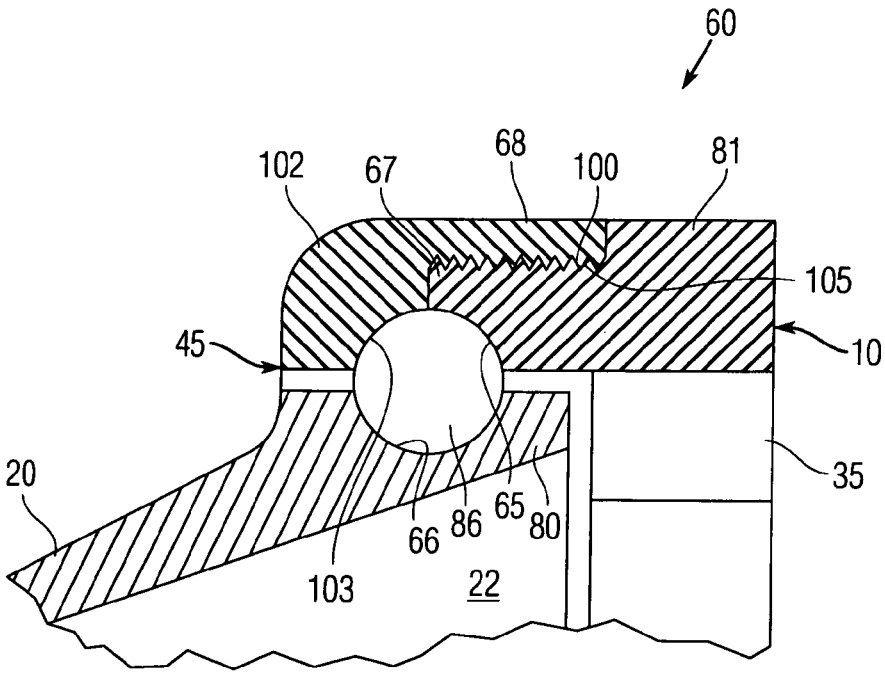
FIG. 5 is a fragmentary section showing a ball bearing arrangement similar to that of FIG. 1, but at an enlarged scale and in greater detail.
Figure 6:
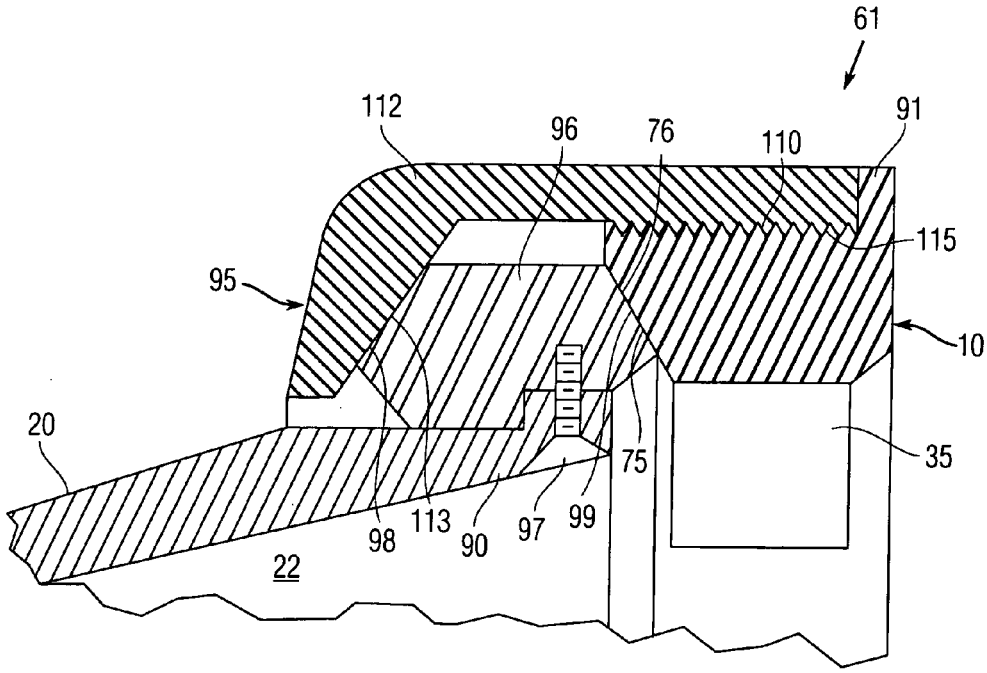
FIG. 6 is a fragmentary section showing a bearing arrangement utilizing sliding surfaces similar to that of FIG. 2, but at an enlarged scale and in greater detail.

It is apparent from FIGS. 5 and 6 that structures 60 and 61 have opposing force and moment transfer surfaces borne by circular elements coaxially related to gyroscopic stabilizing ring 10. These elements being screwthreadably connected as described below. Surfaces 65 and 75 of these elements are sometimes termed "second bearing surfaces" in the claims and rotate with the ring. Surfaces 66 and 76 of these elements are sometimes termed "first bearing surfaces" in the claims and are fixed to missile 11 at its nozzle 20. It may be seen that surfaces 65 and 66 are disposed in facing relation axially of ring 10 as are surfaces 75 and 76.

It is also apparent that structures 60 and 61 have respective first annular mounting elements 80 and 90 which are portions of nozzle 20, and have second annular mounting elements 81 and 91, which are respective portions of ring 10. In FIG. 5, elements 80 and 81 are connected by mounting elements indicated generally by numeral 45, and elements 90 and 91 are connected by elements indicated generally by numeral 95. Elements 45 includes a ball 86, which is one ball of a ball bearing.

In FIG. 6, element 95 includes an annular bearing ring 96. Ring 96 extends around mounting element 90, which is the rearward portion of nozzle 20. Rotation therebetween being prevented in any suitable manner, as by screws, one of which is indicated by numeral 97. Ring 96, in an exemplary embodiment, may be constructed of any suitable ant-friction material, and have a cross section of an elongated hexagonal shape so that the ring has a forward sliding bearing surface 98 and a rearward sliding bearing surface 99.

In FIG. 5, connecting elements 45 include a connecting ring 102 disposed around mounting element 80, the ring 102 may bear a third bearing surface 103 facing second bearing surface 66. In FIG. 6, correspondingly, connecting elements 95 include a connecting ring 112 disposed around mounting element 90. Ring 112 bearing a third bearing surface 113 facing second bearing surface 76.

In FIG. 5, connecting elements 45 include first screwthreads 100, which are coaxially related to and borne by gyroscopic stabilizing ring 10 and may be disposed about mounting member 81 outwardly of ball 86. In FIG. 6, correspondingly, connecting elements 95 include first screwthreads 110, which are coaxially related to and borne by gyroscopic stabilizing ring 10 and may be disposed about mounting member 91 outwardly of bearing ring 96.

In FIG. 5, connecting element 45 includes second screwthreads 105 disposed on connecting ring 102 and disposed to engage first screwthreads 100 so as to draw stablilizing ring 10 and nozzle 20, together with their respective mounting members 81 and 80, into the assembled relationship as shown. Likewise, as shown in FIG. 6, connecting element 95 includes second screwthreads 115 disposed on connecting ring 112 and disposed to engage first screwthreads 110 so as to draw stablilizing ring 10 and nozzle 20, together with their respective mounting members 91 and 90, into the depicted assembled relationship.

It is apparent from FIG. 6 that surfaces 98 and 99 have a bearing function in relation to corresponding, axially facing surfaces 113 and 75. Surfaces 113 and 75 are disposed for heat conduction, respectively, from propulsion gases 24 at the interior of nozzle 20 and vanes 35 by way, respectively, of members 90 and 91. Since the predetermined length for generation of propulsion gas with the above-described shoulder launched missiles is not more than about 0.01, the amount of heat transferred from the propulsion gas to members 90 and 91 is limited. Accordingly, this bearing function is not impaired by this limited amount of heat even though ring 96 is constructed of an anti-friction not normally suited to the temperatures of propulsion gases such as gases 24.

Although the present invention has been herein shown and described in connection with what is conceived as the exemplary embodiments, it is recognized that departures may be made therefrom within the scope of the invention which is not limited to the illustrative details disclosed.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A gyroscopic stabilizer for use with a propelled body where a fluid flow associated with propulsion of the body passes in a predetermined direction relative to the body, comprising:

a ring having a predetermined mass and a predetermined axis;

a bearing mounting the ring rotationally on the body with the ring disposed for passage of the fluid axially of the ring;

a rocket nozzle being a portion of the propelled body terminating at an exit opening for said fluid flow; and at least one vane mounted on the ring and extending radially from the ring into said flow, said at least one vane being configured so that said flow impinging on said at least one vane motivates the ring rotationally about said axis, whereby rotation of the ring about said axis tends to gyroscopically stabilize the body, and wherein said bearing is disposed on said rocket nozzle at said exit opening and mounts the ring at said exit opening for rotation of the ring about said exit opening.

2. The gyroscopic stabilizer of claim 1, wherein said fluid flow is external of the body due to passage of the body through a fluid medium, and wherein said at least one vane extends radially outwardly of the ring.

3. The gyroscopic stabilizer of claim 1, wherein said fluid flow comprises gases exiting from a rocket nozzle disposed in propulsive relation to the body, wherein the ring is mounted on the body so that said fluid flow passes centrally of the ring, and wherein said at least one vane extends radially inwardly of the ring.

4. The gyroscopic stabilizer of claim 3, wherein said at least one vane is one vane of a plurality of vanes disposed so as to extend into said gases.

5. The gyroscopic stabilizer of claim 1, wherein said at least one vane is one vane of a plurality of vanes; wherein said ring has a predetermined outer diameter; and wherein the axial length of said ring is less than said predetermined outer diameter.

6. The gyroscopic stabilizer of claim 3, wherein said rocket nozzle defines an exit opening for said gases, wherein said exit opening is circular and has a predetermined exit diameter, wherein said ring is coaxially related to said exit opening and has an outer diameter greater than said predetermined exit diameter, and wherein the axial length of said ring is less than said predetermined exit diameter.

7. The gyroscopic stabilizer of claim 3, wherein said rocket nozzle is a portion of the body and defines an exit opening for said gases, wherein said exit opening is circular and has a predetermined exit diameter, wherein said ring is coaxially related to said exit opening and has an inner diameter corresponding to said predetermined exit diameter, and wherein the axial length of said ring is not more than one fourth of said inner diameter.

8. A method of stabilizing a missile launched from within a launching tube, the missile including a rocket bearing a nozzle with a gas exit opening from which propulsion gas exits before the missile leaves the launching tube, comprising:

providing the missile with a stabilizing ring mounted on the missile in fixed axial relation to the missile and at said gas exit opening for rotation about said gas exit opening, said stabilizing ring having a plurality of rotating vanes disposed so as to extend into propulsion gas exiting from said gas exit opening; and initiating propulsion gas generation by said rocket so that propulsion gas exiting from said gas exit opening impinges on said vanes and drives said stabilizing ring to an rotational speed sufficient to gyroscopically stabilize the missile before the missile leaves the launching tube.

9. The method of claim 8, wherein exiting of said propulsion gas exit from said nozzle terminates before the missile leaves the launching tube.

10. The method of claim 9, wherein the stabilizing ring has a predetermined moment of inertia, wherein said propulsion gas has predetermined velocity characteristics, and wherein said vanes are configured so that said propulsion gas having said predetermined velocity characteristics drives said stabilizing ring to said rotational speed sufficient to gyroscopically stabilize the missile before exiting of said propulsion gas from said nozzle terminates.

11. A gyroscopic stabilizer for use with a missile having a nozzle with a circular opening for exit of propulsion gas, comprising:

a stabilizing ring having a moment of inertia, a central axis, and an inner diameter corresponding to the diameter of said circular opening;

a plurality of rotating vanes fixedly connected to the ring and extending radially inwardly from the ring, said vanes being configured to rotationally drive the ring when the vanes are impinged upon by said propulsion gas passing through said inner diameter;

a rocket nozzle being a portion of the missile terminating at the circular opening for said propulsion gas; and a bearing mounting the ring on the missile with the ring being disposed in coaxial relation to said circular opening and with the rotating vanes disposed for impingement by propulsion gas exiting from said circular opening, wherein the ring is rotatable about said circular opening when the ring is impinged upon by said propulsion gas exiting from said circular opening, forces due to impingement of said propulsion gas on the vanes and directed axially of the ring are transferred to the missile without axial displacement of the ring along said central axis relative to the missile, and moments due to gyroscopic reaction in planes intersecting said central axis being transferred to the missile without displacement of the ring relative to the missile, wherein said moments tend to stabilize the missile in said planes, and wherein said bearing is disposed on said rocket nozzle at said circular opening and mounts the ring at said circular opening of exit for rotation of the ring about said circular opening.

12. The gyroscopic stabilizer of claim 11, wherein the bearing utilizes rolling elements.

13. The gyroscopic stabilizer of claim 11, wherein the bearing utilizes sliding surfaces.

14. The gyroscopic stabilizer of claim 11, wherein, at said bearing, rotation of the ring in relation to said circular opening, transfer of said forces due to impingement of said propulsion gas on the ring, and transfer of said moments due to gyroscopic reaction occur between at least one surface rotating with the ring and at least another surface fixed to the missile, and wherein the missile, the ring, and said surfaces are maintained in assembled relation by a pair of opposing circular elements coaxially related to the ring, said surfaces are disposed between said opposing circular elements, one of said opposing circular elements is fixed to the ring, and the other of said opposing circular elements is screwthreadably attached to said one of said opposing circular elements.

15. In a weapon system, a combination, comprising:

a rocket nozzle having a circular exit opening for propulsion gas;

a gyroscopic stabilizing ring;

a bearing mounting the gyroscopic stabilizing ring rotationally on a body with the gyroscopic stabilizing ring disposed for passage of the propulsion gas;

a first annular mounting member on the nozzle;

a second annular mounting member on the gyroscopic stabilizing ring;

a plurality of rotating vanes extending centrally of the gyroscopic stabilizing ring; and elements connecting said mounting members so that the gyroscopic stabilizing ring is maintained in coaxial disposition to said exit for rotation relative to said circular exit opening by said propulsion gas and so that the gyroscopic stabilizing ring is maintained in an axial disposition relative to the nozzle for transfer of axial forces and moments between the nozzle and the gyroscopic stabilizing ring;

wherein said bearing is disposed on said rocket nozzle at said circular exit opening and mounts the gyroscopic stabilizing ring at said circular exit opening for rotation of the gyroscopic stabilizing ring about said circular exit opening.

16. The combination of claim 15, further comprising a generally cylindrical missile having the nozzle, the gyroscopic stabilizing ring being attached to the missile with the missile coaxially related to said circular exit opening and to the gyroscopic stabilizing ring.

17. The combination of claim 16, wherein the missile includes a rocket motor generating said propulsion gas for a predetermined length of time, and wherein the combination further comprises a launching tube receiving the missile, the length of the launching tube is selected so that when said propulsion gas is generated the missile exits the launching tube after said predetermined length of time, said gas rotates the gyroscopic stabilizing ring during said predetermined length of time, and the missile is gyroscopically stabilized by rotation of the missile gyroscopic stabilizing ring before the missile exits the launching tube.

18. The combination of claim 16, wherein the missile includes a rocket motor generating said propulsion gas for a predetermined length of time, wherein the first annular mounting member and the second annular mounting member comprise mutually facing sliding surfaces having a bearing function, and wherein said predetermined length of time is not more than about 0.01 second so that, during said predetermined length of time, the amount of heat transferred from said propulsion gas to the first annular mounting member and to the second annular mounting member is limited and said bearing function is not impaired by said amount of heat.

19. The combination of claim 16, wherein the first annular mounting member and the second annular mounting member comprise mutually facing sliding surfaces having a bearing function, wherein the missile includes a rocket motor generating said propulsion gas for a predetermined length of time, and wherein at least on of said mutually facing sliding surfaces comprises a solid anti-friction material.

20. The combination of claim 15, wherein said first annular mounting member is fixed to the nozzle and has a first bearing surface of the combination, wherein said second annular mounting member is fixed to the gyroscopic stabilizing ring for rotation with the gyroscopic stabilizing ring and has a second bearing surface of the combination, wherein said first and second bearing surfaces are disposed in facing relation axially of the gyroscopic stabilizing ring, and wherein said elements connecting said mounting members include first screwthreads coaxially related to the gyroscopic stabilizing ring and disposed about the second mounting member, a connecting ring disposed around said first mounting element and having a third bearing surface of the combination facing said second bearing surface of the combination, second screwthreads engaging said first screwthreads and disposed so as to draw said gyroscopic stabilizing ring, said first annular mounting member, and said second annular mounting member into an assembled relationship.

* * * * *